US010040623B2

(12) United States Patent
Zanchet

(10) Patent No.: US 10,040,623 B2
(45) Date of Patent: Aug. 7, 2018

(54) CONTAINER FOR PACKAGING AND TRANSPORTING A SET OF MULTIPLE GLASS PANELS OR THE LIKE

(71) Applicant: César Valentim Zanchet, Barueri (BR)

(72) Inventor: César Valentim Zanchet, Barueri (BR)

( * ) Notice: Subject to any disclaimer, the term of this patent is extended or adjusted under 35 U.S.C. 154(b) by 142 days.

(21) Appl. No.: 14/906,143

(22) PCT Filed: Mar. 28, 2014

(86) PCT No.: PCT/BR2014/000102
§ 371 (c)(1),
(2) Date: Jan. 19, 2016

(87) PCT Pub. No.: WO2015/006841
PCT Pub. Date: Jan. 22, 2015

(65) Prior Publication Data

US 2016/0167870 A1 Jun. 16, 2016

(30) Foreign Application Priority Data

Jul. 17, 2013 (BR) ..... 132013018216

(51) Int. Cl.
*B65D 85/48* (2006.01)
*B65B 23/20* (2006.01)

(52) U.S. Cl.
CPC ..... *B65D 85/48* (2013.01); *B65B 23/20* (2013.01)

(58) Field of Classification Search
CPC .... B65D 85/48; B65D 71/00; B65D 71/0092; B65B 23/20

(Continued)

(56) References Cited

U.S. PATENT DOCUMENTS 5,682,997 A * 11/1997 Bartholomew .... B65D 71/0092 206/451
5,909,808 A 6/1999 Bartholomew
2006/0156683 A1 7/2006 Valentim Zanchet

FOREIGN PATENT DOCUMENTS

BR PI0303311 10/2012

OTHER PUBLICATIONS

International Search Report for International Application No. PCT/BR2014/000102, dated May 28, 2014, Instituto Nacional DA Propriedade Industrial, Rio de Janeiro, BR.

* cited by examiner

*Primary Examiner* — Andrew Perreault
(74) *Attorney, Agent, or Firm* — B. Aaron Schulman, Esq.; Stites & Harbison, PLLC

(57) ABSTRACT

A container to be used as an evelope to protect the perimeter of the block formed by multiple panels packaged into the container, for example flat glass panels or panels of other materials to be transported in the vertical position; the container comprises a framework formed by a set of modular troughs, including an upper trough, a lower trough and a pair of identical side troughs, which are essentially composed of longitudinal profiles with a U-shaped cross-section and a narrow width for receiving a multiple panels; these profiles are made of laminated paper or another suitable material, the profiles of the upper trough and lower trough comprising reinforcement zones for binding by means of strips, the reinforcement zones being formed by the juxtaposition of pairs of steel plates on the flat surface of the longitudinal profiles, while the longitudinal profiles of each side trough also receive a protection cover that has a U-shaped cross-section and is made of steel; the flat inside surface of the profiles of the modular troughs receives internal supports for accommodating and protecting the (Continued)

peripheral edges of the multiple panels packaged inside the framework.

7 Claims, 5 Drawing Sheets

(58) Field of Classification Search
USPC ..... 206/451
See application file for complete search history.

Cut F.F

CONTAINER FOR PACKAGING AND TRANSPORTING A SET OF MULTIPLE GLASS PANELS OR THE LIKE

FIELD OF THE INVENTION

The present invention, is directed to an industrial container to be used as an envelope to protect the perimeter of the block formed by a set of panels packaged into the container, for example, flat glass panels or panels of other materials to be transported in the vertical position, thus making it possible to handle said panels by lifting same for displacing and transporting same wherein, especially, said industrial container comprises a structural framework comprised of a set of modular troughs provided with internal supports for suitably accommodating panels, a reinforcing means for assembling anchoring strips, in addition to angle plates for supporting steel cables in such a way to assure the proper lifting of the a set of panels for transportation, storage, and the like.

BACKGROUND OF THE INVENTION

As already anticipated in the main application, the transportation of glass panels or the like is generally carried out by assembling same on racks, which are integrally are made of wood and configured by a pair of pedestals provided with protecting wedges where mirrored angular walls are formed, thus making out the structural framework for the juxtaposition of glass panels.

Another kind of container found in the market for accommodating and transporting flat glass is configured by a structural framework comprised of four U-shaped cross-section troughs which are attached to one another and made of wood, the inner portion of each trough being provided with wedges which are, in turn, made of rubber for supporting the edges of every flat glass packaged therein. Said framework type containers are also known as "End Caps" and are traditionally used in flat glass storage and transportation logistics.

But this kind of container is extremely heavy due to the substantial volume and material used, besides the fact that wood panels make it difficult to assemble same, thus bringing about a slow and laborious production.

Another inconvenience is the fact that the constructiveness of said container makes it impossible to disassemble same, thus requiring the use of a huge area for storing the container.

Another inconvenience is the fact that the containers made of treated wood require a sanitary treatment when designed to be exported, thus increasing the cost for trading same.

BRIEF DESCRIPTION OF THE INVENTION

For the purpose of improving the process described herein, thus cooperating in the sense of improving the accommodation and transportation of flat glass or the like, the applicant has developed an improved industrial container for accommodating and transporting multiple glass panels or the like.

Said improved industrial container comprises a structural framework formed by multiple modular troughs, especially comprised of longitudinal profiles with a U-shaped cross-section made of laminated paper or any other suitable material, so that said profiles may be coated integrally or partially by U-shaped cross-section steel plates that can fit into profile.

Said set of modular troughs is formed by an upper trough, a lower trough and a pair of side troughs, all of which are provided with internal supports made of rubber panels or ethylene vinyl acetate—EVA—panels for accommodating and protecting the peripheral edges of the set of packaged panels.

Said upper/lower troughs embody reinforcement zones for binding by means of strips, said reinforcement being attained by the juxtaposition of pairs of steel plates on the laminated paper profile, while the laminated profile of each side trough receives a protection cover that is also made of steel and provided with external reinforcements, besides supporting angle plates which, in turn, have an inverted L-shaped section for supporting steel cables or the like for lifting the structural framework and the set of packaged panels.

The association of the narrow width of the framework with the angularity provided by the lifting cables through the accommodation and positioning of said angle plates in the side troughs brings about a reduced compressive stress, thus cooperating with the displacement and transportation of the industrial container.

The main advantage is the novel constructive characteristics of the industrial container, mainly the elimination of wood panels for making out the framework, thus providing a narrow low-weight container and, consequently, cooperating with the lifting as well as transportation of the set of packaged panels.

Another advantage is the modularity of the set of troughs that makes it easy to store the container so that it occupies a substantially lower volume for the storage and transportation, thus reducing the costs related to the logistics.

DETAILED DESCRIPTION OF THE INVENTION

Figure 1:
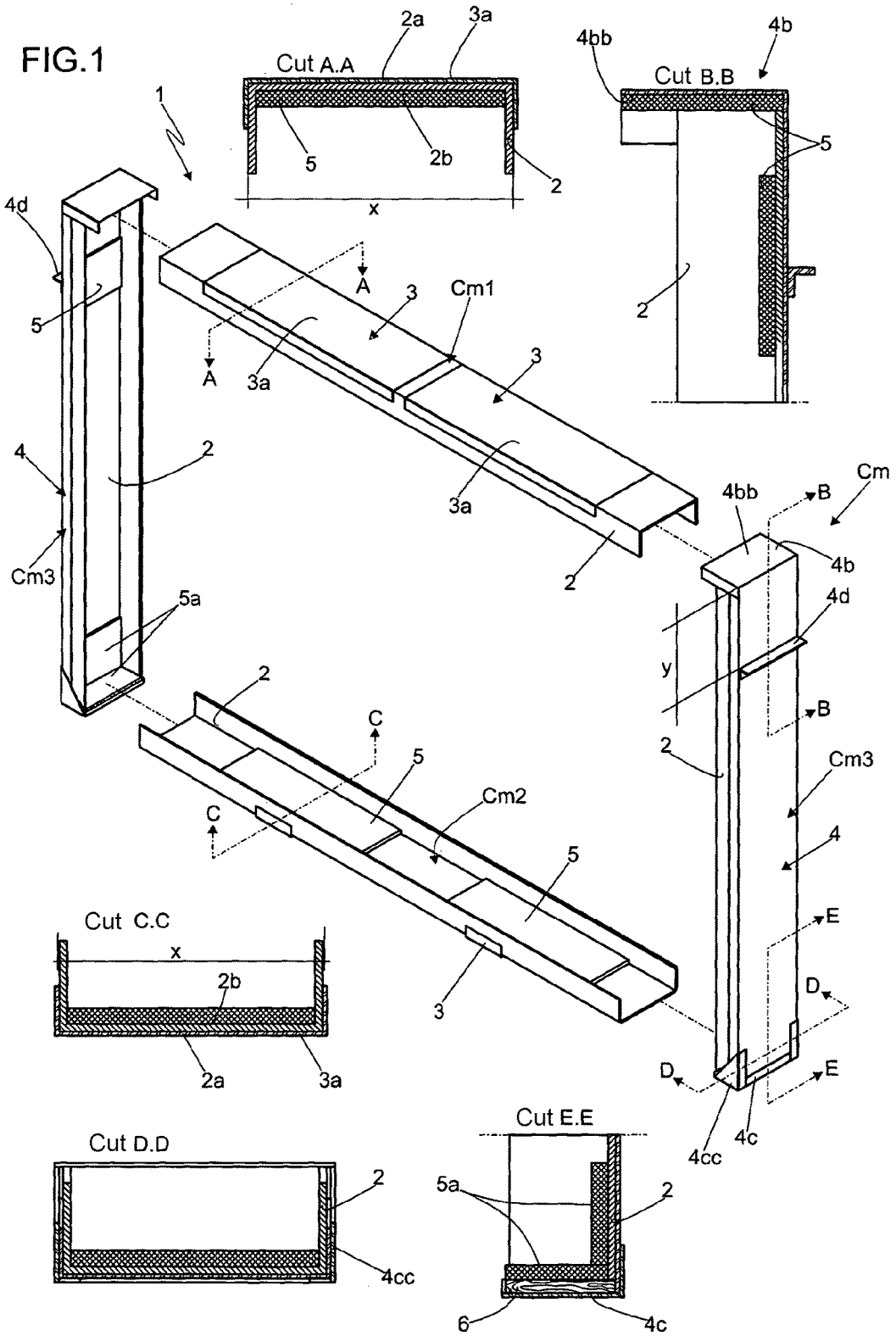
FIG. 1 represents a perspective view of the elements that make out the industrial container with respective details in cuts A.A, B.B, C.C, D.D and E.E shown in FIG. 1.
Figure 2:
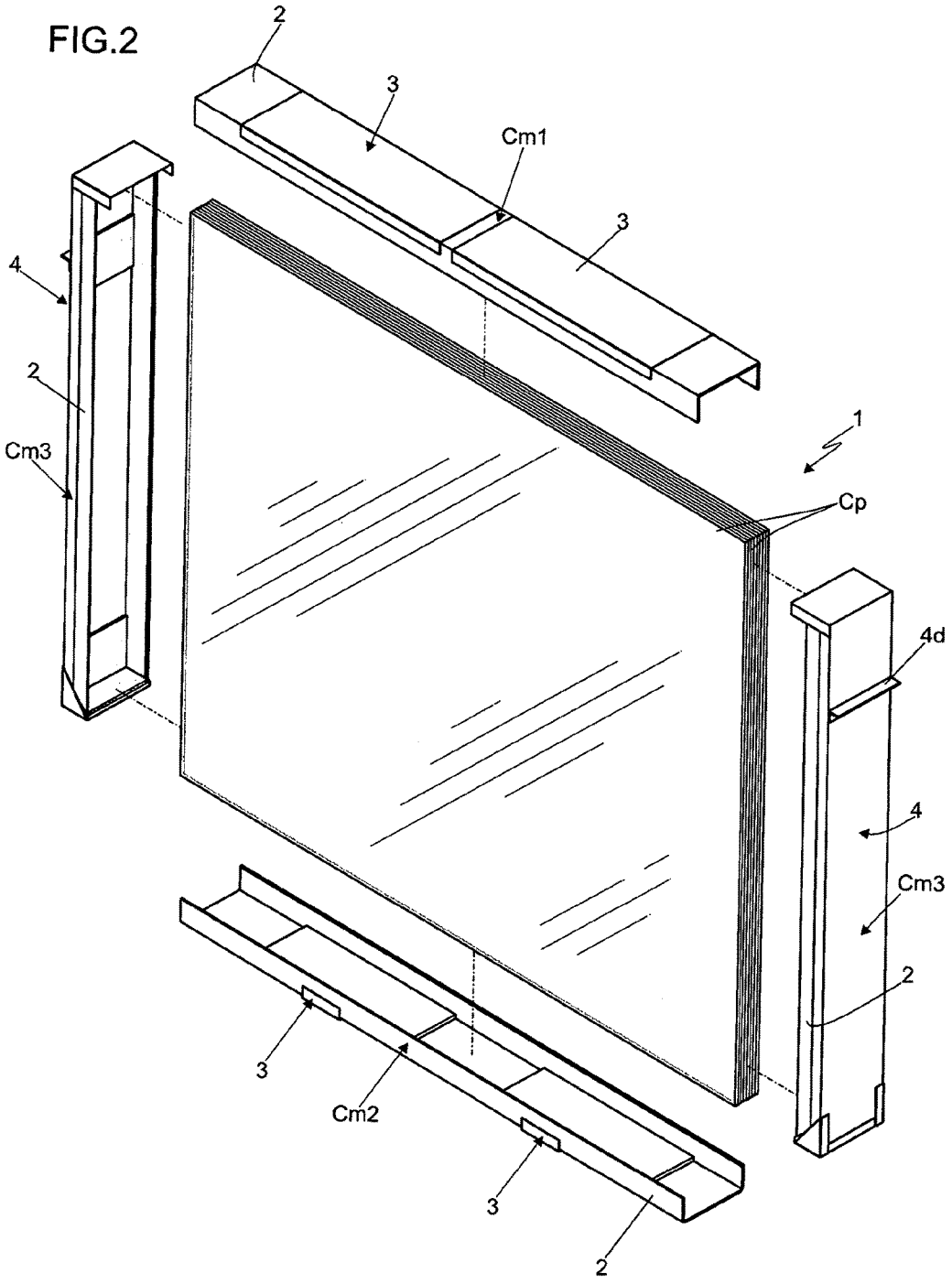
FIG. 2 depicts a perspective exploded view of both the set of troughs and the set of glass panels.
Figure 3:
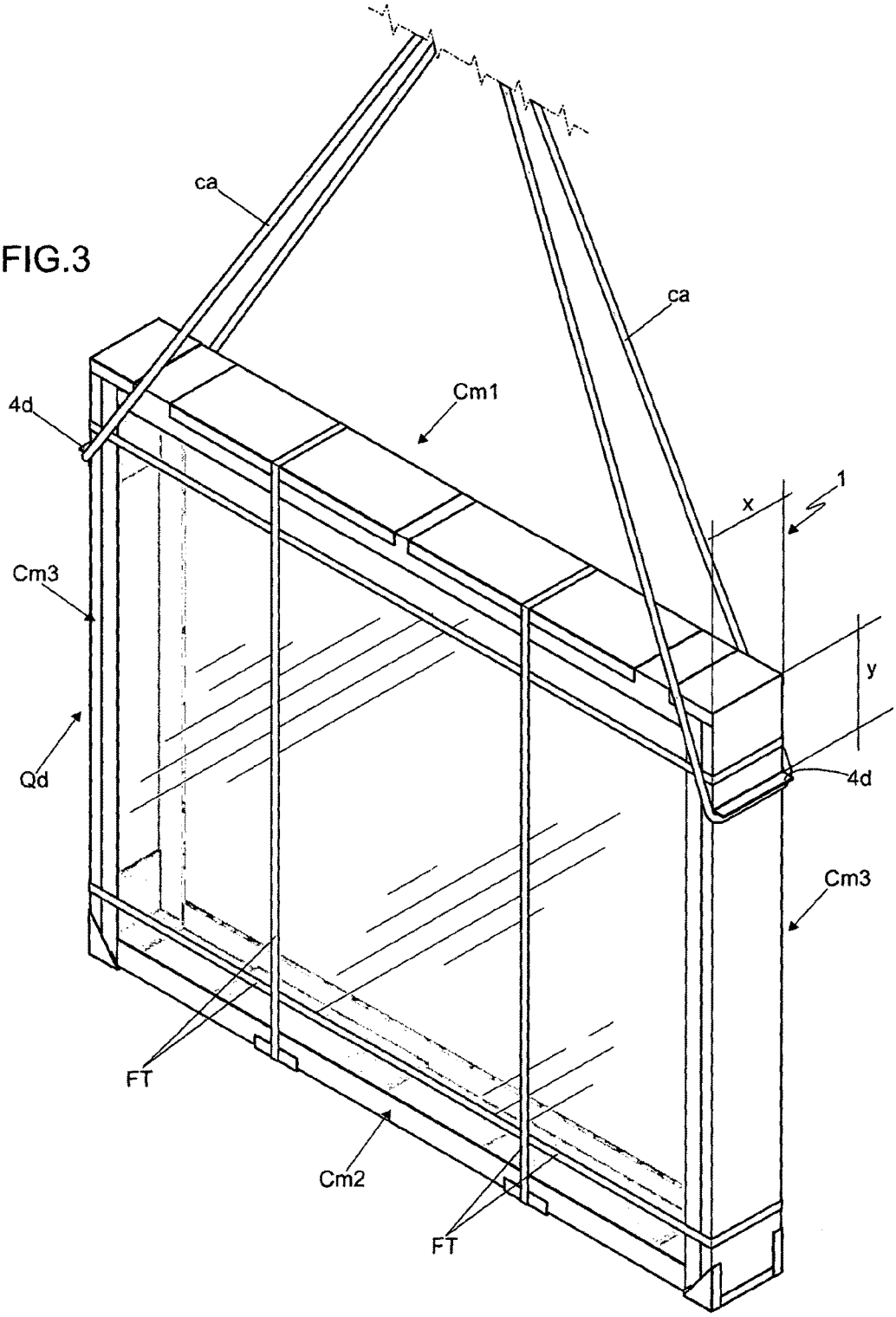
FIG. 3 shows a perspective view of the container and sets of packaged panels illustrating the troughs attachment and assembly of the steel cable for lifting.
Figure 4:
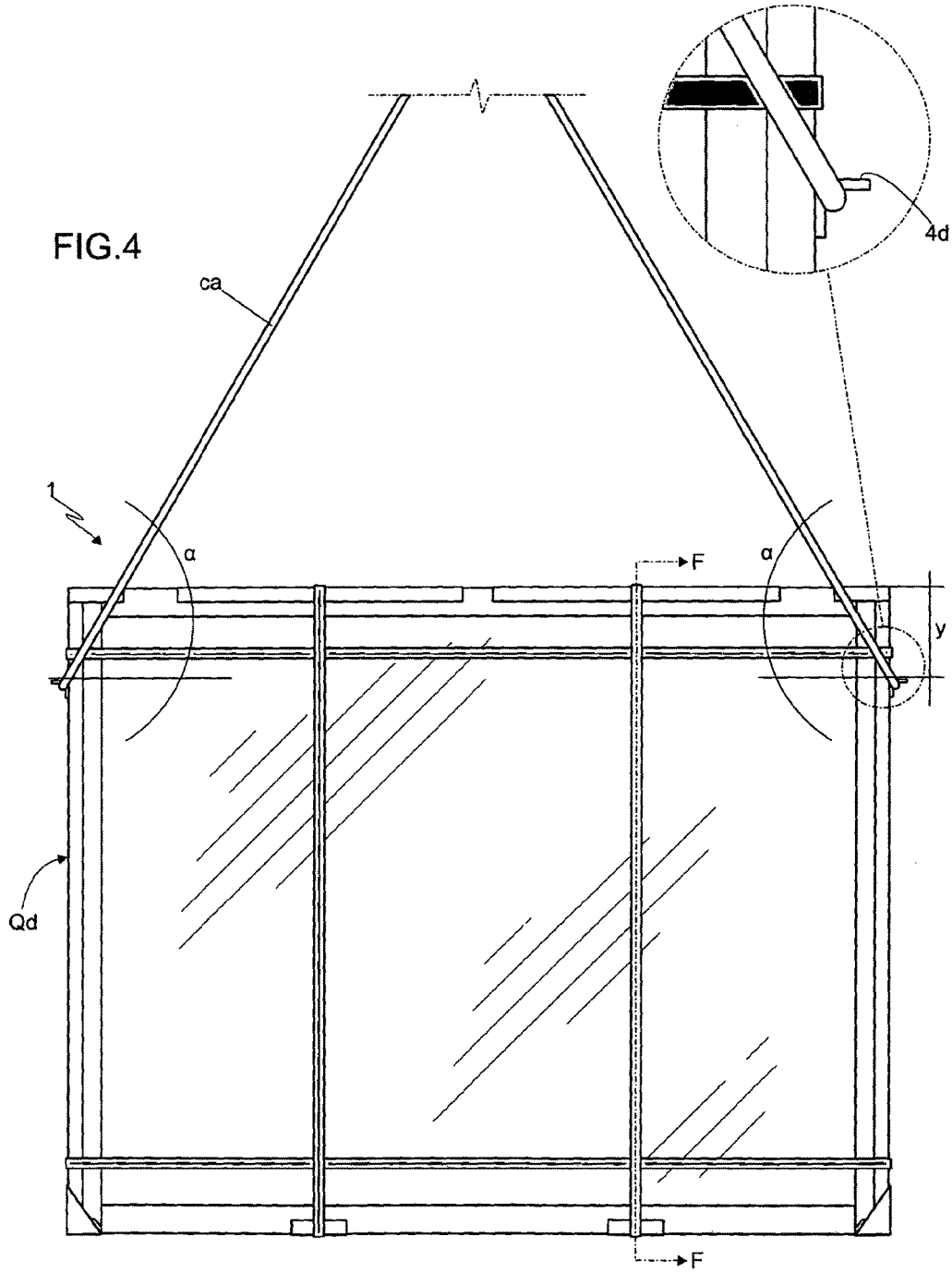
FIG. 4 represents a front view of the industrial container illustrating the angularity of the lifting cables.
Figure 5:
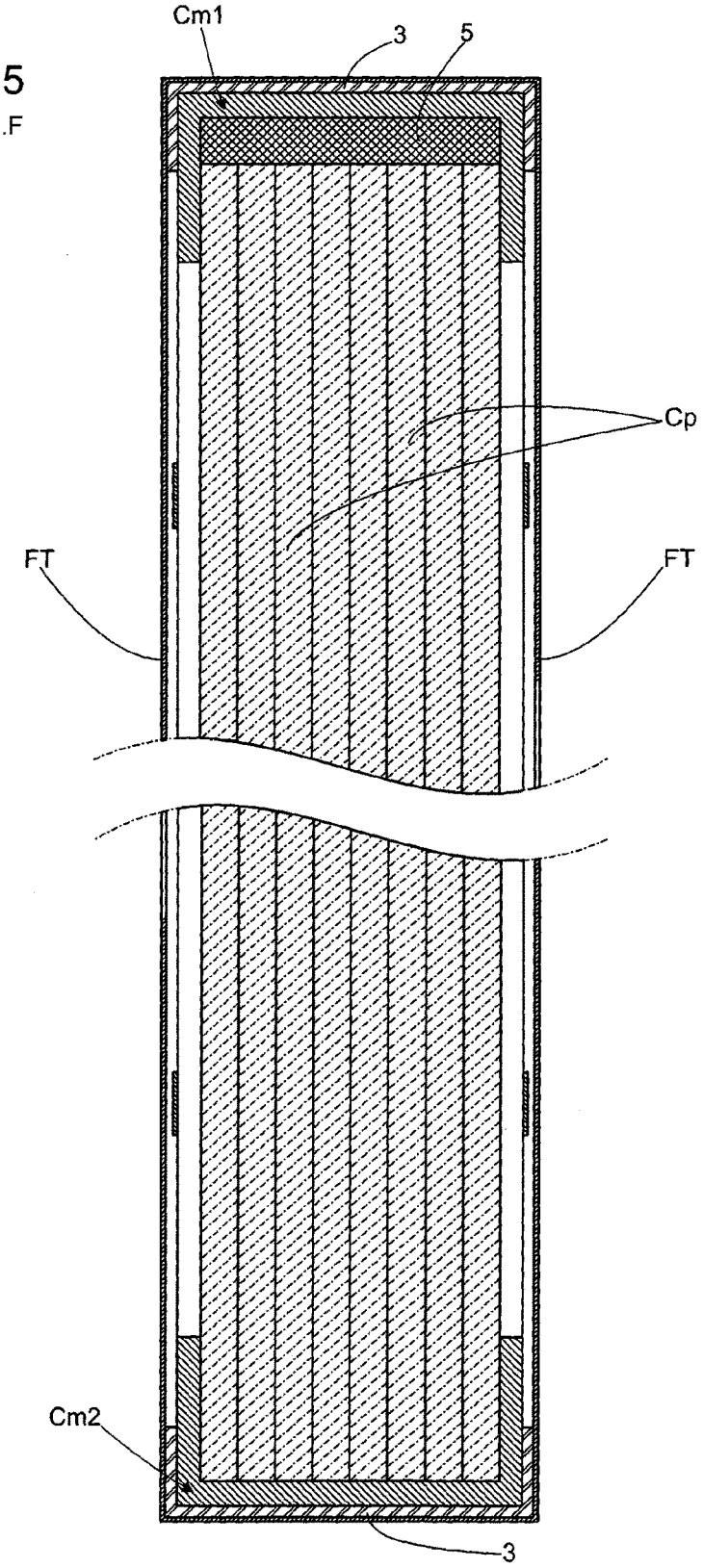
FIG. 5 shows a longitudinal view F.F shown in FIG. 4.

In view of the above, the applicant presents an improved industrial container for packaging and transporting multiple glass panels or the like, more precisely an industrial container (1) to be used as an envelope to protect the perimeter of the block formed by the set of panels (Cp) packaged in the container (1), for example, flat glass panels or other materials to be transported in the vertical position.

In accordance with the present invention, the industrial container (1) comprises a structural framework (Qd) formed by a set of modular troughs (Cm) including an upper trough (Cm1), a lower trough (Cm2) and a pair of identical side troughs (Cm3) which are basically composed of longitudinal profiles (2) with a U-shaped cross-section and narrow width (x) developed for receiving a set of panels (Cp). Said profiles (2) are made of laminated paper or other suitable material, while the profiles (2) of the upper trough (Cm1) and lower trough (Cm2) are provided with reinforcement zones (3) for binding by means of strips (FT), the reinforcement zones being formed by the juxtaposition of pairs of steel plates (3*a*) on the flat external surface (2*a*) of the longitudinal profiles (2), while the longitudinal profiles (2) of each side trough (Cm3) also receive a protection cover (4) that has a U-shaped cross-section and is made of steel.

The internal flat surface (2*b*) of the profiles (2) of the modular troughs (Cm) receive internal supports (5) comprised of panels (5*a*) made of rubber or ethylene vinyl acetate—EVA—for accommodating and protecting the peripheral edges of the set of panels (Cp) packaged in the framework (Qd).

In a preferential constructive version, the end portions (4*b*) and (4*c*) of the covers (4) that compose the side troughs (Cm3) are configured by orthogonal walls wherein the end wall (4*b*) has an extension (4*bb*) for receiving the end portions of the upper trough (Cm1), while the external surface of the end wall (4*c*) has a structural reinforcement in the form of trapezoidal panels (4*cc*) that covers the edges of the same cover (4). The internal surface of the wall (4*c*) receives a reinforcement plate (6) made of plywood or any other suitable type juxtaposed by the internal support (5).

Near the end (4*b*) of each cover (4) is provided a supporting angle plate (4*d*) preferably with an inverted L-shaped cross-section for attaching the steel cables (ca) or the like for lifting the structural framework (Qd) and the set of packaged panels (Cp).

Each angle plate (4*d*) is kept at a distance (y) in relation to the extension (4*bb*) of the end portion (4*b*) in such a way that the association of the narrow width (x) of the profiles (2) that compose the troughs (Cm1), (Cm2), and (Cm3) promotes a 60° angularity ($\alpha$) of the lifting cables (ca), thus generating reduced compressive stress for the displacement and transportation of the industrial container (1).

So, the present certificate of addition does not change the scope of the object requested in the main document, thus not only acting as an accessory to the invention, but also improving the present inventive concept.

The invention claimed is:

1. A container for packaging and transporting a set of multiple panels, the container comprising:

a structural framework comprising a set of modular troughs, including an upper trough, a lower trough and a pair of identical side troughs;

wherein each trough comprises a U-shaped longitudinal profile, having an external flat surface and a width sized to receive the set of multiple panels;

the upper trough and the lower trough have reinforcement zones comprising pairs of rigid plates adhered on the external flat surface of the upper and lower troughs;

wherein the internal surfaces of the upper trough, the lower trough and the side troughs have internal supports constructed and arranged to accommodate and protect the set of multiple panels;

wherein each side trough has a rigid U-shaped protection cover on its external flat surface, the cover having an upper orthogonal wall end portion, and a lower orthogonal wall end portion, each wall end portion having an external surface and an internal surface;

wherein the upper wall end portions have extensions which receive end portions of the upper trough and the lower wall end portions have extensions which receive end portions of the lower trough;

wherein the external surface of each lower wall end portion has a structural trapezoidal panel which covers edges of the cover; and wherein the internal surface of each lower wall end portion has a reinforcement plate between the internal surfaces and the internal supports.

2. The container according to claim 1, wherein each upper orthogonal wall end portion is provided with a supporting angle plate constructed and arranged to attach steel cables for lifting the structural framework and the set of multiple panels so that each supporting angle plate is kept at a distance in relation to the extension of the end portion.

3. The container according to claim 2, wherein the angle between the steel cables and the side troughs is 60°.

4. The container according to claim 1, wherein the internal supports are panels made of rubber or ethylene acetate vinyl—EVA.

5. The container according to claim 1, wherein the U-shaped longitudinal profile of each trough is made of laminated paper.

6. The container according to claim 1, wherein the rigid U-shaped protection cover is made of steel.

7. The container according to claim 1, wherein the reinforcement plate is made of plywood.

* * * * *